United States Patent [19]

Diamantides

[11] 4,163,962

[45] Aug. 7, 1979

[54] UNIVERSAL IMPEDANCE POWER APPARATUS

[76] Inventor: Nick D. Diamantides, 2517 14th St., Cuyahoga Falls, Ohio 44223

[21] Appl. No.: 769,311

[22] Filed: Feb. 17, 1977

[51] Int. Cl.[2] ..... H01F 7/08

[52] U.S. Cl. ..... 335/222; 335/231

[58] Field of Search ..... 335/209, 231, 272, 222; 310/36, 38, 67

[56] References Cited

U.S. PATENT DOCUMENTS

| | | | |
|---|---|---|---|
| 1,852,232 | 4/1932 | Buchhold | 335/272 |
| 2,986,683 | 5/1961 | Lavet et al. | 310/36 X |
| 3,299,381 | 1/1967 | Adams | 335/272 X |

*Primary Examiner*—George Harris

[57] ABSTRACT

The subject matter of the present invention is a universal impedance element of electric power transmission and distribution use, having either fixed or controllably variable magnitude. One and the same unit of such element can be made to function as an inductor, condenser, contactless voltage regulator, fault-current attenuator, or arcless circuit breaker, by either choosing the magnitude of one mechanical and/or one electrical parameter.

3 Claims, 3 Drawing Figures

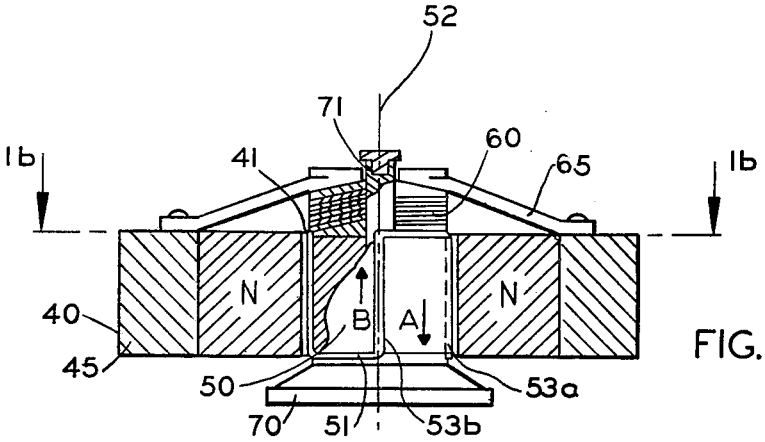
FIG. 1a
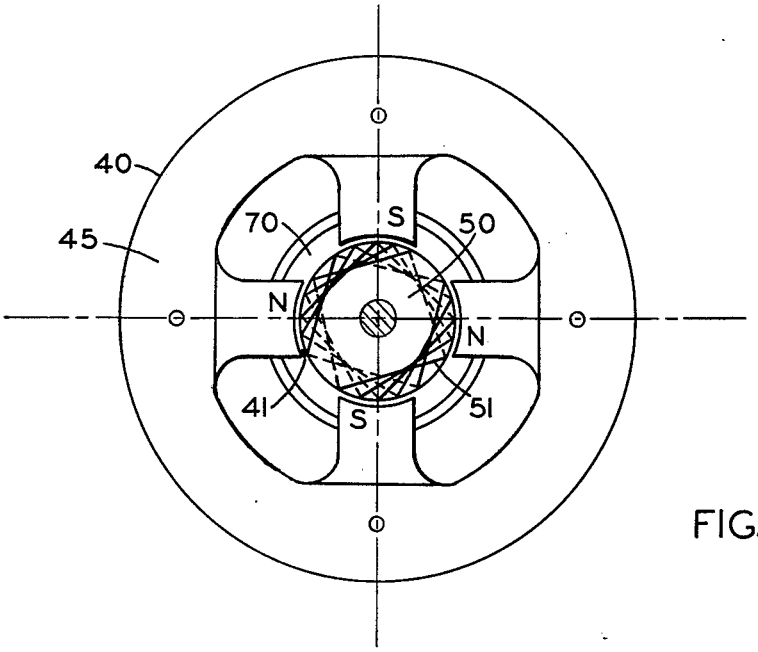
FIG. 1b
FIG. 2
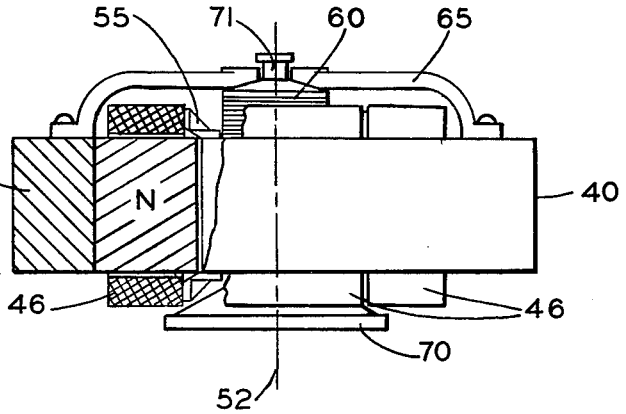
FIG. 2a
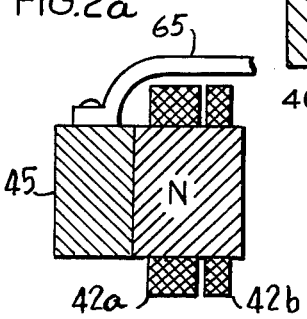

UNIVERSAL IMPEDANCE POWER APPARATUS

This invention relates to equipments used in the field of transmission, distribution and utilization of electric power, and in particular to the area of impedance implementing devices such as reactors, capacitors, regulators, circuit breakers, and fault-current attenuators.

In applicant's patent application, Ser. No. 591,297, filed on June 30, 1975, and granted Letters Pat. No. 4,048,602 on Sept. 13, 1977 there was disclosed a universal impedance power apparatus whose principle of operation is the forced oscillation of an armature mass within a magnetic field by means of a coil traversed by the line current, the coil itself being a part of the oscillating mass, and the magnetic field being generated either by a permanent magnet, or by an electromagnet whose magnetizing coil is fed by a continuous current of fixed polarity. The oscillation, which can be either rotational or translational, is opposed by a spring. The combination of the spring constant and of either the polar moment of inertia of the armature in the rotational case, or of the mass in the translational case, establishes a natural frequency of oscillation for the armature-spring system. In the foregoing arrangement it is the armature that undergoes oscillatory motion, while the magnet remains immobile by being rigidly connected to the supporting structure of the apparatus. The name multimpeder is given to the aforesaid apparatus.

Although the above system of universal impedance apparatus fulfills the basic requirements of efficiency, simplicity and long life under operational conditions, it has become obvious to the applicant that further improvements beyond the specific implementation first disclosed can be had, and the apparatus' utility and efficiency increased. In this revised implementation the kinematic roles of the magnet and armature are reversed, with the armature held immobile relative to the supports of the device, and with the magnet mounted so that it is free to oscillate in relation to the armature and against the force of the spring. In addition, the geometry of the magnet is altered in a manner increasing its inertia and the surface area of its poles.

Construction of an improved universal impedance apparatus possessing the aforesaid feature of oscillating magnet and immobile armature accordingly becomes the principal object of this invention, with other objects becoming apparent upon reading of the following specification, considered and interpreted in the light of the accompanying drawings in which FIG. 1*a* is an elevated view of the multimpeder comprising a permanent magnet, an armature, and a spring in an arrangement of cylindrical geometry.

FIG. 1*b* is a plan view of the cylindrical geometry multimpeder.

FIG. 2 is an elevated view of the multimpeder with the magnet being an electromagnet.

FIG. 2*a* is an elevated partial view of the multimpeder having the electromagnet energized by two magnetic coils.

Referring now to the configuration of my invention shown in FIGS. 1*a* and 1*b*, it will be seen that the multimpeder comprises in combination the main magnet 40, consisting of a ring-shaped yoke 45 and poles N, S of alternate magnetic polarity. The yoke is made of magnetically soft material, while the poles are either permanent magnets, or electromagnets whose magnetic coils 46 (FIG. 2) are fed by direct current, the free ends of the poles having a cylindrical shape providing one side of the annular gap 41, the armature 50 made of magnetic material in the shape of a drum carrying the main coil 51, the armature being attached to the rigid support 70, and the torsion spring 60 which, in the configuration shown, consists of a laminated thrust bearing carrying the magnet 40 through arms 65, and kept centered with respect to the armature 50 by means of the center post 71.

The manner in which the aforesaid three principal members of the multimpeder cooperate to serve the purpose of the invention may be deduced from the individual function of each member. In this respect the function of the magnet 40 is to create the magnetic field which in conjunction with the current flowing in the main coil 51 generates the torque acting between the magnet and the armature 50. In the case of the magnet being an electromagnet, as in FIG. 2, the coils 46 fed by a direct current may either be carried by the poles or, as in the FIG. 2, be attached through a nonmagnetic bracket 55 to the armature 50. In the latter case the coils' inner diameter is made larger than the dimensions of the poles N, S so that the coils do not participate in the oscillation of the poles. This arrangement frees the coils from the vibratory stresses to which they otherwise would have been subjected, and, at the same time, simplifies the dynamic balancing of the magnet itself.

The armature assembly is structured so that the main coil 51 is wound so that at any one moment the current flows in the direction of the arrow A in coil lengths 53*a* facing north magnetic poles N, and in the opposite direction B in coil lengths 53*b* facing south magnetic poles S. This ensures that the electromagnetic forces exerted by individual poles upon the armature have always the same instantaneous direction.

The function of the torsion spring 60 is to resiliently oppose the rotational oscillation of the magnet. Such a spring can be of any one of many forms available, like spiral, helical or torsion bar. In the form of a laminated thrust bearing serves the double purpose of a spring and a support of the weight of the magnet. Laminated bearings are state of the art components consisting of a stack of thin metal laminae interleaved and adhered together by thin alternating layers of elastic rubber or other elastomeric material. Such a layer of rubber-like substance bonded between metal lamine can withstand high compressive loads applied by the metal layers, it being sufficiently thin as to be restrained from substantially flowing sidewise by its adhesion to the metal. Elastomeric bearings, however, are capable of a deformmation in shear parallel to the laminae accompanied by shear stress proportional to the deformation. Thus, the laminate bearing behaves in a soft spring like fashion in a plane parallel to the laminae, and its spring rate or compliance may be adjusted as desired through proper selection of the dimensions of the stack and the characteristics of the elastomer. This spring rate, coplanar to the laminae, is little affected by any compressive forces that may be applied perpendicularly to the layers. To ensure against radial displacement of the oscillating magnet, a slight conicity is given to the laminae stack of the bearing in this application. It should be evident to those versed in this art that the laminated bearing may be used not only alone but, also, in combination with an ordinary spiral or helical torsion spring should additional spring force be required.

In the arrangement of the three principal multimpeder components described above, the magnet 40 generates a magnetic field linking the segments 53*a* and 53*b* of the main coil that are lying within the air gap 41. Consequently, when an alternating current is passed through the main coil a force f is generated between the coil segments and the magnet, which force, when referred to the axis 52 of the system's cylindrical symmetry, produces a torque on the coil tending to force it and the armature into oscillatory motion. By the principle of action and reaction an equal and opposite torque is applied to the magnet so that, since the armature is held immobile, it is the magnet that will be set into an oscillatory motion.

The amplitude q (radians) of this oscillatory motion is described by the differential equations $$Esinwt = Li^{(1)} + Ri + Blrq^{(1)}, \quad (1)$$

$$Blri = Mq^{(2)} + cq^{(1)} + kq, \quad (2)$$

in which the symbols have the following meaning:

E is the line voltage, is the frequency (60 Hz) of the line voltage,

L is the inductance of the main coil 51,

R is the resistance of the main coil 51, i is the current through the main coil, B is the strength of the magnetic field in the air gap 41, l is the total length of the main coil exposed to the magnetic field B, r is the radius of the cylindrical air gap 41, M is the polar moment of inertia of the magnet 40 about the axis 52, c is the coefficient of a viscous damping of the oscillatory motion, whose magnitude may include the value zero, k is the compliance of the spring 60, and (1), (2) indicate first and second time-derivatives respectively.

The behavior of the multimpeder governed by equations (1) and (2) has been greatly elaborated in U.S. Pat. No. 4,048,602, the only difference being that in the present case the magnet undergoes the mechanical oscillation instead of the armature. Therefore, as proven in the copending application, the magnet polar inertia and the spring compliance constitute a resonant system whose resonance frequency can be made either fixed or changeable by changing the mass of the magnet or the spring compliance. If these two parameters are so chosen as to cause the resonance frequency to be lower than the power line frequency of 60 Hz, the multimpeder is in a state of preresonance and behaves like a condenser or capacitor; while if the resonance frequency is made higher than the line frequency, the multimpeder is in a state of postresonance and behaves as a reactor. In either case the magnitude of the impedance presented to the line by the multimpeder can be made to change smoothly in response to line voltage variations or to a power factor deviation from unity, where the power factor is defined as the trigonometric cosine of the phase angle between the line voltage E and current i. This smooth change, effected by varying the magnitudes of either the magnet's inertia M, or of the spring's compliance K, makes the multimpeder a stepless voltage regulator. In both cases above the effective impedance of the multimpeder is made up of the ordinary electrical impedance of the main coil 51 to which is added vectorially the reflected mechanical impedance of the inertia-spring system. When the resonance frequency is set at 60 Hz, the effective impedance becomes very large because it causes the multimpeder to assume a state of resonance; in this state the multimpeder behaves as a fault current attenuator or an arcless circuit breaker. Preresonance, resonance, and postresonance are collectively referred to as levels of vibratory state. As explained in the copending application the resonance frequency may be controlled not only mechanically, but also through purely electromagnetic means that change the effective strength B of the magnetic field within the air gap 41. In addition to the various ways of effecting such control elaborated upon in U.S. Pat. No. 4,048,602, the multimpeder structure of FIG. 2 makes possible a particularly simple method of vibratory state level control. The method amounts to splitting each magnetic coil 46 into a base magnetic coil 42*a* and a control magnetic coil 42*b* as diagrammed in FIG. 2*a*, each of the two coils fed by separate current. While the base coil direct current is steady and supplies the bulk $B_o$ of the magnetic field B, the control coil current can vary in both intensity and polarity by an amount $\pm\Delta B$. Thus, the total magnetic field becomes $$B = B_o \pm \Delta B, \quad (3)$$

its value being adjusted by the component $\Delta B$ so the desired level of vibratory state of the multimpeder is attained.

While the present description of the multimpeder makes use of specific configurations of the armature coil, and of the magnet as the generating means of the magnetic field, their design is not meant to be so restricted. Either more or fewer than two pairs of magnetic poles placed in a circular arrangement around the armature may be utilized, with the main coil appropriately expanded to engage the magnetic field of such multiple pole arrangement. Furthermore, the winding of the main coil may be arranged in a variety of ways in which parts of it may be connected in series or in parallel or various combinations thereof. It will be apparent to those skilled in the art that various changes may be made to the embodiments of the invention described herein without departing from the spirit of the invention or the scope of the appended claims.

What is claimed is:

1. A multimpeder as described comprising in combination an electromagnet having opposite magnetic poles separated by an air gap, said air gap being of cylindrical shape and traversed by the magnetic field created by said magnetic poles, said magnetic field being substantially orthogonal to the face of said poles, an armature positioned within said air gap and immovably attached to rigid supports, said armature being equipped with a main coil capable of carrying an alternating current, said main coil being within said magnetic field, a torsion spring connecting said main electromagnet to said rigid supports, said electromagnet being capable of rotational oscillatory motion about said armature, said motion being resiliently opposed by said torsion spring, said electromagnet having an inertia, and said spring having a compliance, said inertia and said compliance being selected as to cause said electromagnet spring system to be maintained at a desired level of vibratory state at the frequency of said alternating current, said electromagnet having base magnetic coils fed by direct current, the magnitude of said direct current supplying the bulk of said magnetic field, said electromagnet having, additionally, control magnetic coils arranged in a manner similar to said base magnetic coils, said control magnetic coils being capable of varying said magnetic field in both intensity and polarity.

2. The device of claim 1, with said base and control magnetic coils arranged so that they do not participate in the vibratory motion of said electromagnet.

3. The device of claim 1 with said torsion spring being a laminated bearing.

* * * * *